US008250999B2

(12) United States Patent
Mizuno

(10) Patent No.: US 8,250,999 B2
(45) Date of Patent: Aug. 28, 2012

(54) SEWING MACHINE WITH DETACHABLE NEEDLE PLATE

(75) Inventor: Noboru Mizuno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 358 days.

(21) Appl. No.: 12/591,305

(22) Filed: Nov. 16, 2009

(65) Prior Publication Data

US 2010/0212563 A1 Aug. 26, 2010

(30) Foreign Application Priority Data

Feb. 26, 2009 (JP) ..... 2009-043977

(51) Int. Cl.
*D05B 73/12* (2006.01)

(52) U.S. Cl. ..... 112/260

(58) Field of Classification Search ..... 112/260, 112/258, 259, 217.1, 181
See application file for complete search history.

(56) References Cited

U.S. PATENT DOCUMENTS 4,493,280 A * 1/1985 Bianchi ..... 112/260
4,876,975 A * 10/1989 Braun ..... 112/260
6,082,279 A * 7/2000 Ito et al. ..... 112/314
7,194,969 B2 * 3/2007 Niizeki et al. ..... 112/260
2010/0175601 A1 * 7/2010 Fukao ..... 112/260
2010/0212563 A1 * 8/2010 Mizuno ..... 112/260

FOREIGN PATENT DOCUMENTS

JP U-55-139878 10/1980
JP A-2007-244721 9/2007

* cited by examiner

*Primary Examiner* — Danny Worrell
(74) *Attorney, Agent, or Firm* — Oliff & Berridge, PLC

(57) ABSTRACT

A sewing machine includes a feed dog which transfers workpiece cloth, a needle plate having a first hole through which a needle is passed and a second hole through which a feed dog is movable upward and downward, a bed to which the needle plate is detachably attachable, a feeding mechanism which drives the feed dog in a front-back direction and in an up-down direction, an engaged portion formed in the needle plate, an engaging portion formed in the feed dog or the feeding mechanism, and a switching unit which switches the feed dog or the feeding mechanism between a transfer position where the feed dog transfers the workpiece cloth and a needle plate adjusting position which differs from the transfer position and where the engaging and engaged portions are engaged with each other thereby to determine a fixing point of the needle plate on the bed.

9 Claims, 13 Drawing Sheets

SEWING MACHINE WITH DETACHABLE NEEDLE PLATE

CROSS-REFERENCE TO RELATED APPLICATIONS

This application is based upon and claims the benefit of priority from the prior Japanese Patent Application No. 2009-43977 filed on Feb. 26, 2009, the entire contents of which are incorporated herein by reference.

BACKGROUND

1. Technical Field

The present disclosure relates to a sewing machine provided with a needle plate detachably attachable to a bed thereof.

2. Related Art

A sewing machine includes a needle plate detachably attached to a bed thereof. The needle plate has a rectangular hole through which a feed dog is moved upward and downward so as to appear above and disappear below the needle plate and a needle hole through which a needle is passed. The rectangular hole is formed into such a size that the feed dog is movable therethrough. On the other hand, the needle hole is formed into such a size that a needle is passable therethrough during sewing, for example, in straight stitches or zigzag stitches. The needle hole is further formed so as to be as small as possible in order that workpiece cloth may be prevented from being pulled by a needle thereby to drop thereinto during sewing.

Some types of sewing machines are provided with a straight stitch needle plate and a zigzag stitch needle plate both of which are separate from each other. In this case, a user needs to selectively change between the straight and zigzag stitch needle plates. Furthermore, when carrying out a maintenance work for the sewing machine, the user sometimes detaches the needle plate. In re-attachment, the needle plate once detached needs to be attached to the bed so that the needle hole thereof accurately corresponds with a needle location. However, a clearance between the needle hole and the needle is small since the needle hole is small as described above. Accordingly, it is difficult to attach the needle plate to the bed so that the needle hole accurately corresponds with the needle location.

In view of the aforementioned difficulty, there is provided a sewing machine in which a location of the needle plate attached to the bed is adjustable. More specifically, the sewing machine is provided with an adjusting eccentric pin which is adjusted so that the needle plate is fixed to a bed frame (the bed) by a tension screw after a fixing point thereof has been fine adjusted. However, an adjusting work is troublesome in the above-described sewing machine. Accordingly, although it may be suggested to determine the fixing point of the needle plate only by the tension screw and to fix the needle plate to the bed, it is difficult to accurately determine the fixing point of the needle plate on the bed since a clearance (an allowance) is generally provided between the tension screw (a male screw) and a female threaded screw hole (a female screw).

SUMMARY

Therefore, an object of the disclosure is to provide a sewing machine in which the fixing point of the needle plate on the bed can accurately be determined by a simpler work.

The present disclosure provides a sewing machine comprising a feed dog configured to transfer workpiece cloth; a needle plate having a first hole through which a needle is configured to be passed and a second hole through which a feed dog is configured to be movable upward and downward; a bed to which the needle plate is detachably attachable; a feeding mechanism configured to drive the feed dog in a front-back direction and in an up-down direction; an engaged portion provided in the needle plate; an engaging portion provided in the feed dog or the feeding mechanism; and a switching unit configured to switch the feed dog or the feeding mechanism between a transfer position where the feed dog is configured to transfer the workpiece cloth and a needle plate adjusting position which differs from the transfer position and where the engaging and engaged portions are engaged with each other, wherein the needle plate adjusting position corresponds to a position where the needle plate is fixed on the bed.

DETAILED DESCRIPTION OF THE DISCLOSURE

A first illustrative example which is applied to a household sewing machine will be described with reference to FIGS. 1 to 15C of the accompanying drawings in which front-back, right-left and up-down directions are shown by respective arrows.

Figure 1:
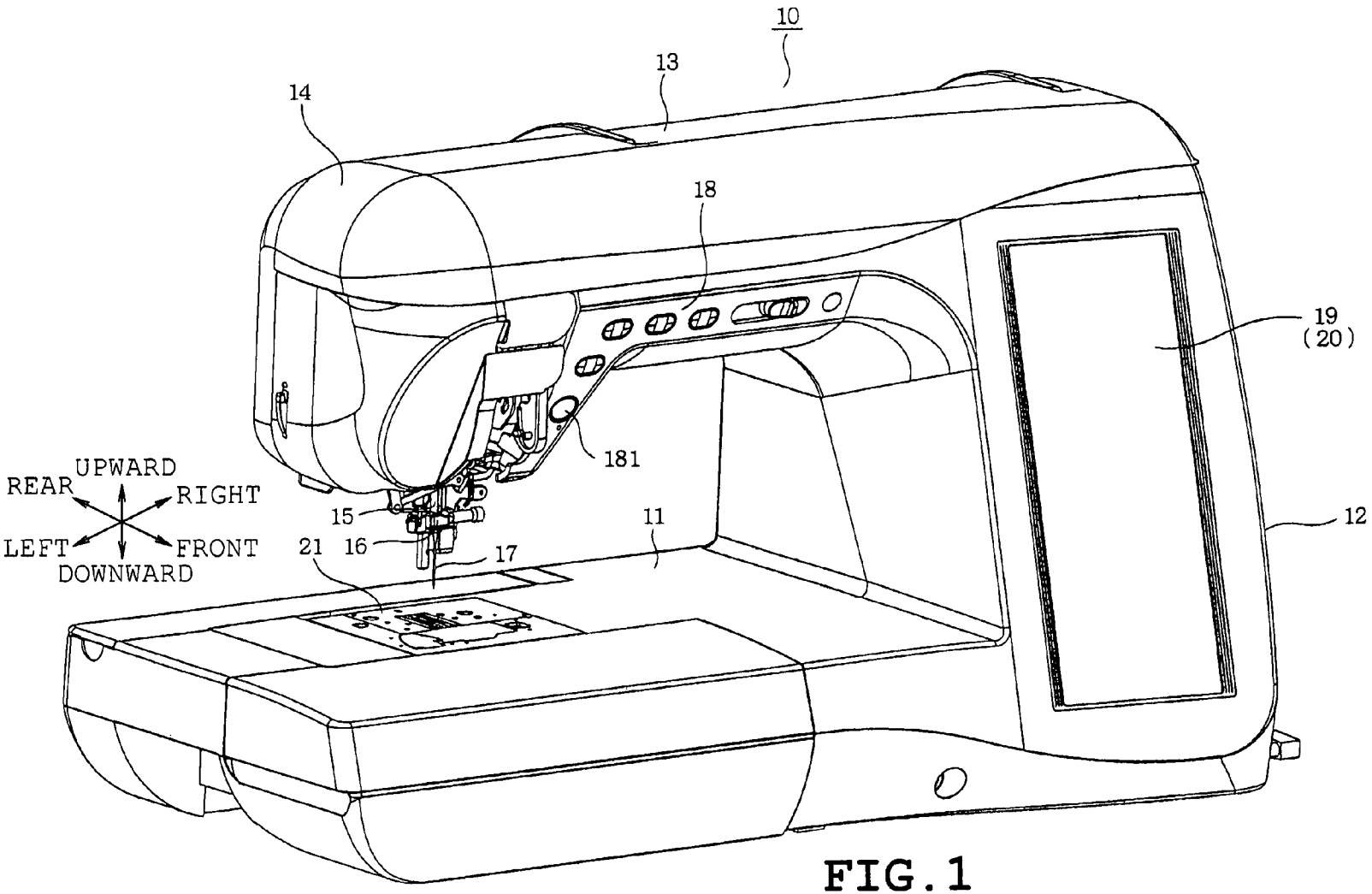
FIG. 1 is a perspective view of a sewing machine in accordance with one illustrative example of the disclosure.

Referring to FIG. 1, a sewing machine 10 includes a bed 11, a pillar 12 and an arm 13. The bed 11 is located at a lower end of the sewing machine 10 and extends horizontally. The pillar 12 stands upward on a right end of the bed 11. The arm 13 extends leftward from an upper end of the pillar 12. A sewing machine main shaft (not shown) extending in the right-left direction is housed in the arm 13. The arm 13 has a head 14 on a left end thereof. The head 14 is provided with a needle bar 15 and a needle thread take-up (not shown).

The main shaft is rotated by a sewing machine motor (not shown). When the main shaft is rotated, the needle bar 15 is moved up and down via a needle bar crank mechanism (not shown). Upon one turn of the main shaft, the needle bar 15 is reciprocated in the up-down direction. The needle bar 15 has a lower end to which a needle 17 is attached via a needle bar connecting bracket 16. Upon rotation of the main shaft, the needle thread take-up is moved up and down via a needle thread take-up crank mechanism (not shown).

A plurality of key switches 18 are mounted on a front of the arm 13 so as to be manually operable. The key switches 18 include a start/stop switch 181 instructing start and stop of a sewing operation, a reverse stitch key, a needle up/down key, a thread cut key and a speed adjusting knob. A liquid crystal display 19 is mounted on a front of the pillar 12. In selection of a desirable sewing pattern, the liquid crystal display 19 displays ordinary patterns such as a plurality of types of practical stitches and decorative stitches. Furthermore, the liquid crystal display 19 displays names of various functions which are to be executed and are necessary for a sewing operation together with various guide messages or the like.

A transparent touch panel 20 having a number of touch keys is mounted on the front of the liquid crystal display 19. The touch panel 19 delivers a signal generated by the depressed touch key to a control device (not shown). The touch panel 20 further serves as an instruction unit which is used when a fixing point of the needle plate 21 on the bed 11 is determined as will be described later.

Figure 2:
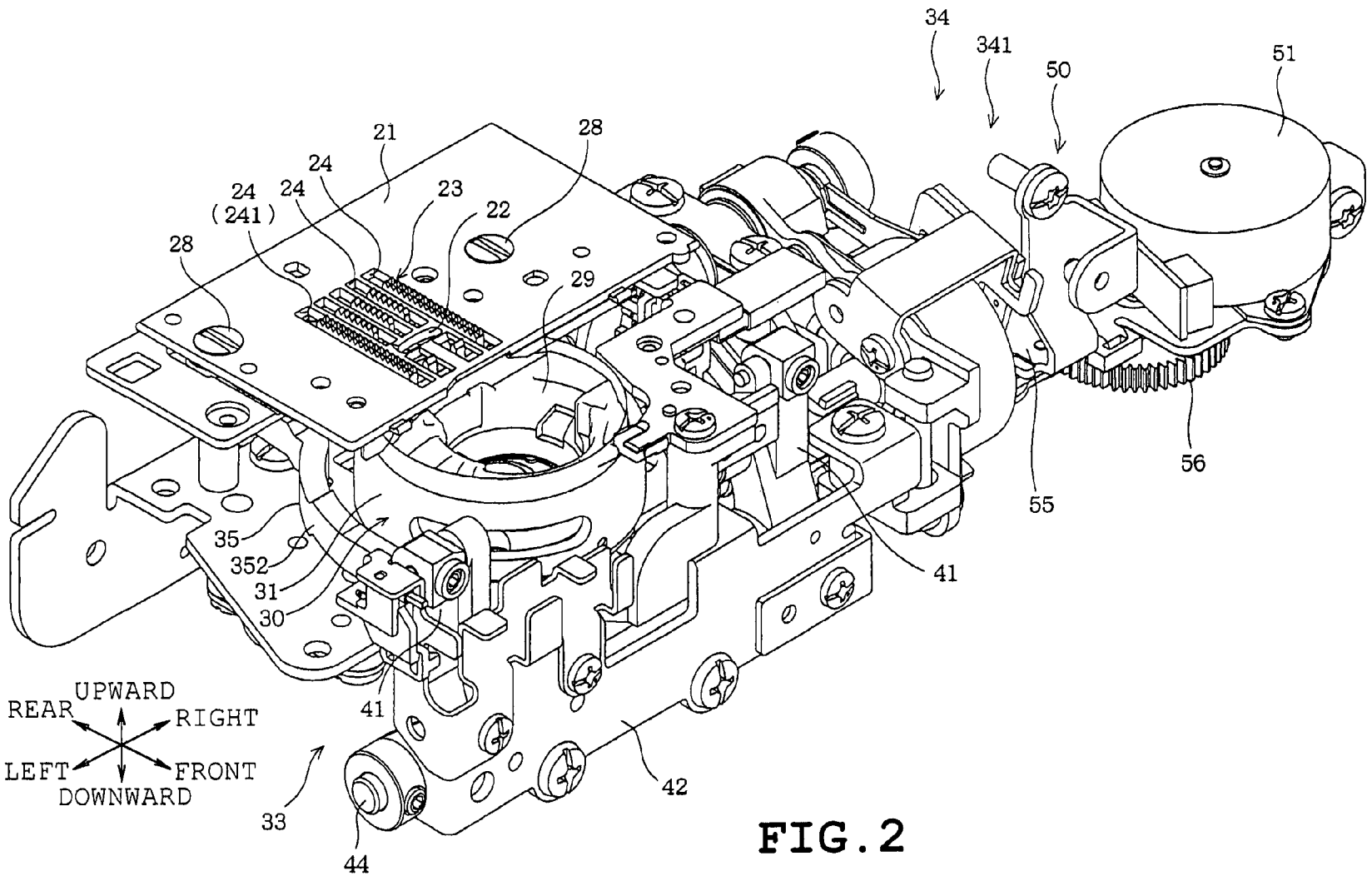
FIG. 2 is a perspective view of mechanisms provided in the bed.
Figure 3:
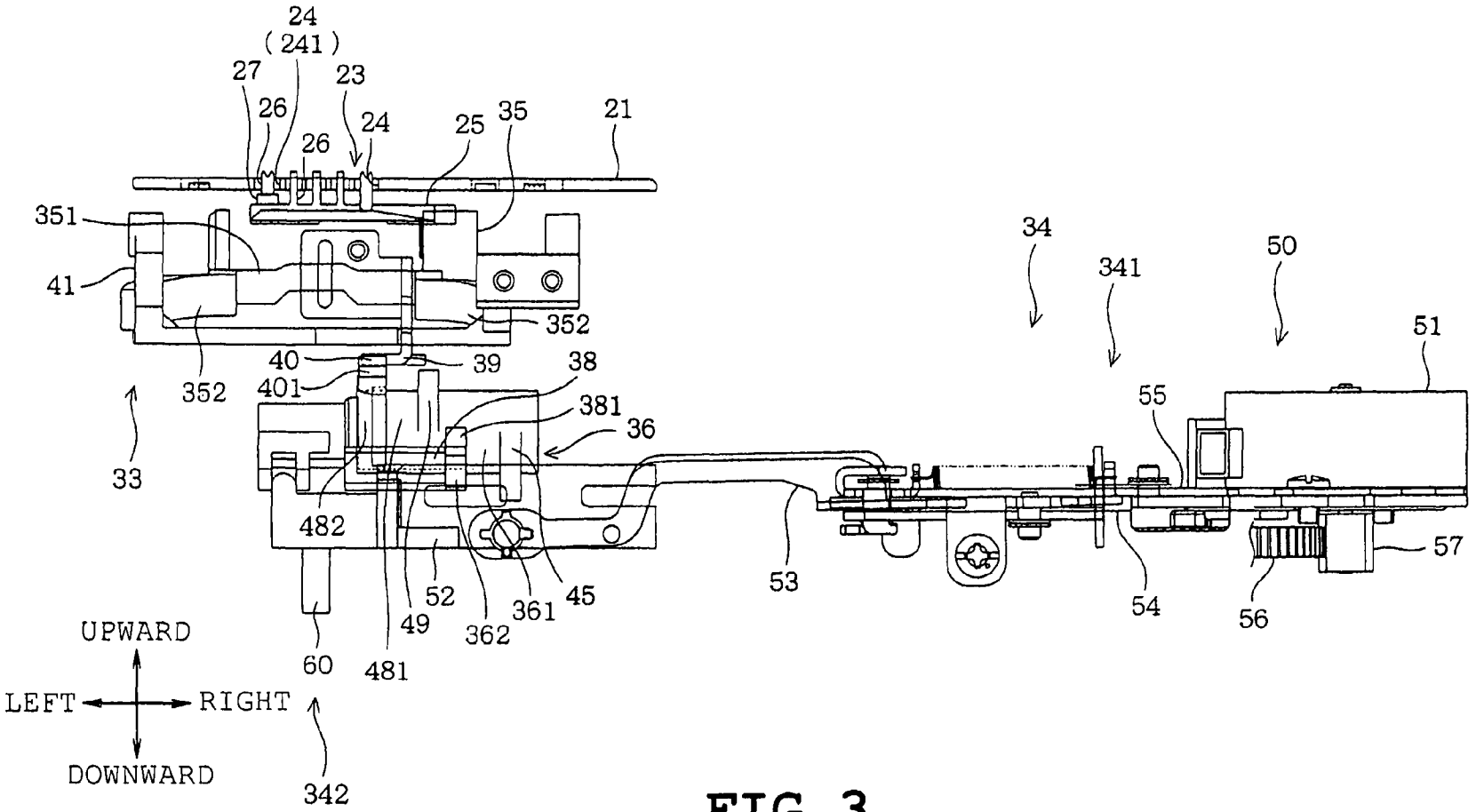
FIG. 3 is a front view of the mechanisms in the bed when a feed dog assumes an upper position.

A needle plate 21 is detachably attached to the bed 11 so as to be opposed to the head 14 of the bed 11. The needle plate 21 is mounted on a unit frame 42 by two tension screws 28, and the unit frame 42 is then fixed to the bed 11. Accordingly, the needle plate 21 will be described as being attached to the bed 21 in the following description. The needle plate 21 has a needle hole 22 through which the needle 17 is passed and a plurality of rectangular holes 24 through which a feed dog 23 appears and disappears, as shown in FIGS. 2 and 3. The needle hole 22 is an extension of the needle 17. The rectangular holes 24 are formed so as to be elongate in the front-back direction. The sewing machine 10 is to be provided with two types of needle plates, that is, a needle plate for straight stitches and a needle plate for zigzag stitches both of which have different shapes of needle holes 22, although not shown in detail.

Figure 4:
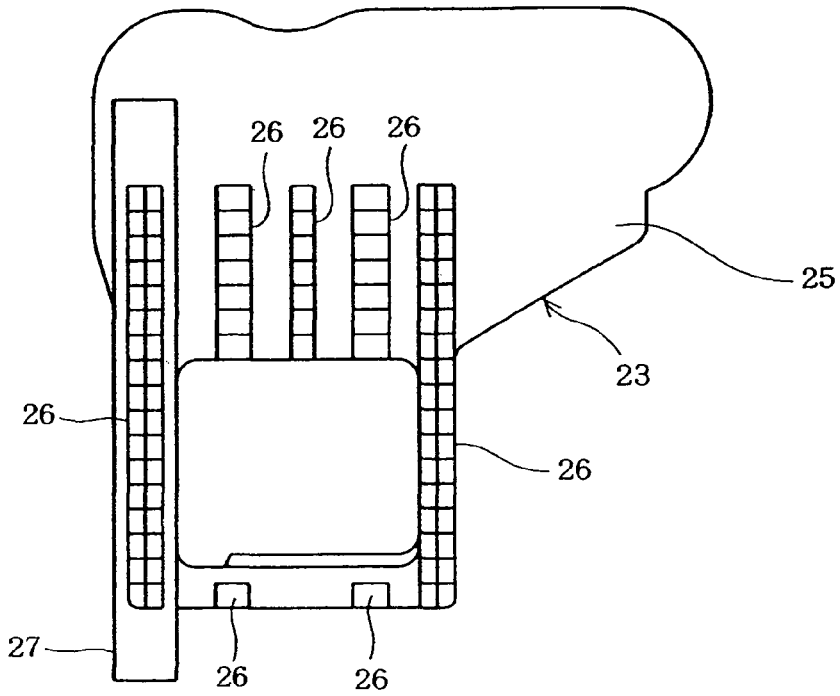
FIG. 4 is a plan view of the feed dog.
Figure 5:
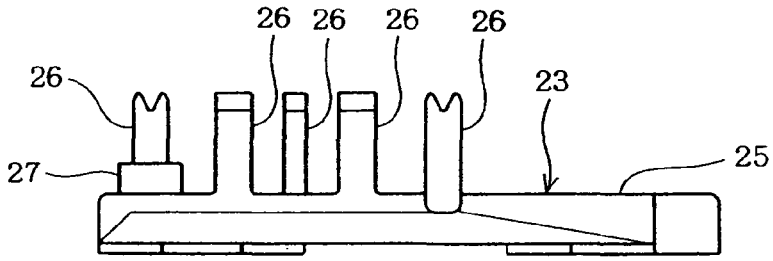
FIG. 5 is a front view of the feed dog.
Figure 6:
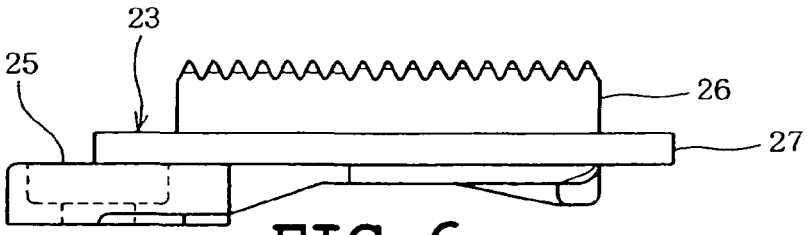
FIG. 6 is a left side view of the feed dog.

The feed dog 23 which transfers a workpiece cloth is provided in the bed 11 and includes a base 25 and teeth 26 formed integrally on the base 25 as shown in FIGS. 4 to 6. The base 25 includes an upper portion supporting the teeth 26. The rows of the teeth 26 are formed so as to correspond to the rectangular holes 24 of the needle plate 21 and have respective upper ends which are brought into contact with the workpiece cloth. The feed dog 23 has a fitting portion 27 which is provided between the base 25 and the teeth 26. The fitting portion 27 is located so as to correspond to a specified engagement one 241 of the plural rectangular holes 24 and shaped so as to be fitted in the rectangular engagement hole 241. More specifically, the fitting portion 27 is formed into the same rectangular shape with substantially the same dimensions as the engagement hole 241. The fitting portion 27 serves as an engaging portion and the engagement hole 241 serves as an engaged portion.

Figure 7:
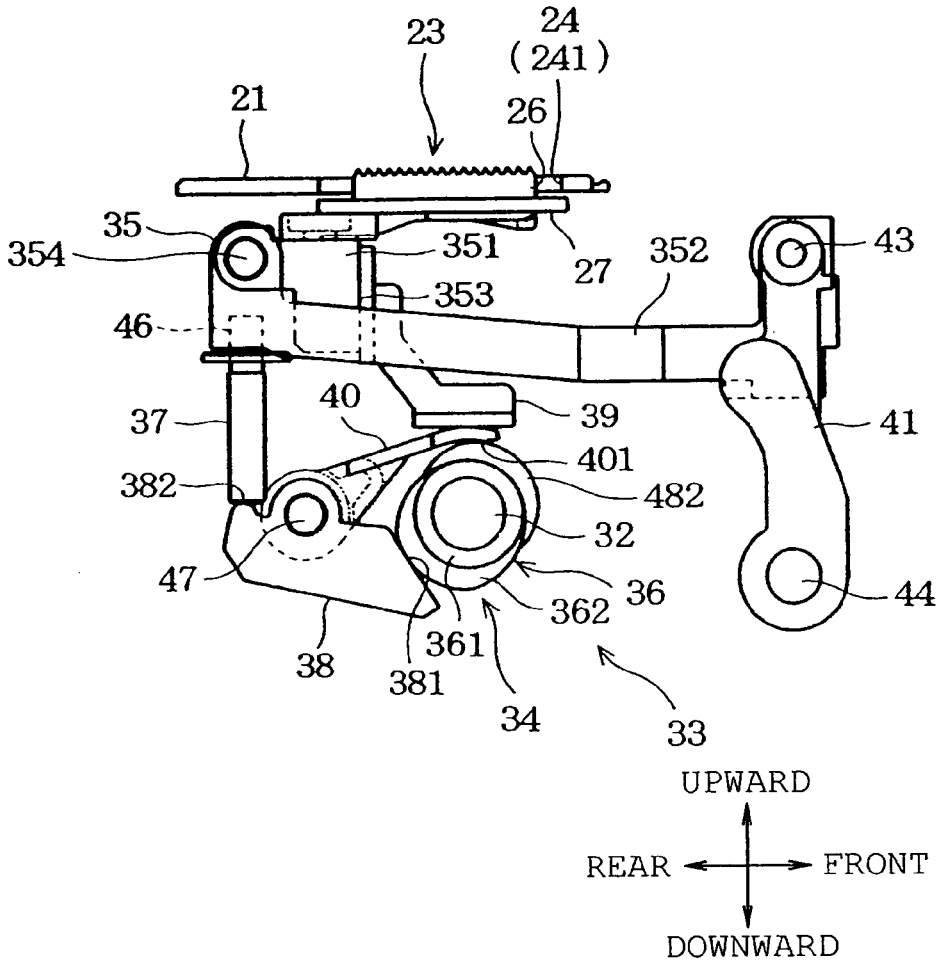
FIG. 7 is a left side view of a feed mechanism in the case where the feed dog assumes an upper position.

A horizontal rotary hook 30 is disposed below the feed dog 23 as shown in FIG. 2. The rotary hook 30 includes a rotating hook 31 and a bobbin case 29 housed in the rotating hook 31. A bobbin (not shown) is detachably accommodated in the bobbin case 29. The rotary hook 30 is rotated by a lower shaft 32 as shown in FIG. 7 although a mechanism for rotating the rotary hook 30 is not shown in detail. The lower shaft 32 is coupled to the main shaft by a timing belt (not shown) so as to be rotated in synchronization with the main shaft, whereupon one turn of the main shaft rotates the lower shaft 32 by one turn. Furthermore, a known detector (not shown) is provided to detect a rotation phase (rotation angle) of the lower shaft 32. The rotation phase of a cam member 36 fixed to the lower shaft 32 as will be described later is detected by the detector.

A feed mechanism 33 drives the feed dog 23 in the front-back direction and the up-down direction. The feed mechanism 33 includes a feed bar 35, a cam member 36, an up-down movement pin 37, a feed contact 38, an auxiliary up-down movement member 39, an auxiliary feed contact 40 and a pair of swing levers 41 swung in the front-back direction. The feed mechanism 33 is housed in a unit frame 42 provided in the bed 11 as shown in FIG. 2. Also in the unit frame 42 is housed a known feed amount adjusting mechanism which adjusts a movement amount of the feed dog 23 in the front-back direction, that is, an amount of feed of the workpiece cloth.

The feed bar 35 includes a body 351 which is located topside and to which the feed dog 23 is fixed, and an open leg 352 which extends along a part of the outer circumference of the rotary hook 30 between the swing levers 41 so as to surround the rotary hook 30, as shown in FIGS. 2, 3 and 7. The open leg 352 includes both ends connected to the respective swing levers 41 as shown in FIG. 7. Two pins 43 are fixed to upper ends of the swing levers 41 respectively. The ends of the open leg 352 of the feed bar 35 are swingably mounted on the pins 43 respectively. On the other hand, the swing levers 41 have lower ends which are supported by the unit frame 42 so as to be swingable about a pin 44, respectively, as shown in FIG. 2. The swing levers 41 are swung in the front-back direction when a feed cam (not shown) mounted on the lower shaft 32 is rotated upon rotation of the lower shaft 32. As a result, the feed bar 35 and the feed dog 23 mounted on the feed bar 35 are swung in the front-back direction.

The cam assembly 36 includes a concentric cam 361, an eccentric cam 362 and a needle plate adjusting cam 45 as shown in FIGS. 3 and 7 to 14. The cam assembly 36 is rotatably mounted on the lower shaft 32. The concentric cam 361 has a cam surface concentric with the lower shaft 32. The eccentric cam 362 has a cam surface set so that a maximum radius of the cam surface thereof is larger than the radius of a cam surface of the concentric cam 361 and so that a minimum radius of the cam surface thereof is equal to the radius of the cam surface of the concentric cam 361. The eccentric cam 362 serves as an up-down feed cam.

The needle plate adjusting cam 45 has a cam contour differing from the eccentric cam 362. More specifically, the needle plate adjusting cam 45 has a cam surface set so that a maximum radius of the cam surface is larger than the maximum radius of the cam surface of the eccentric cam 362 and so that a minimum radius of the cam surface is equal to the radius of the cam surface of the concentric cam 361 and a minimum radius of the cam surface of the eccentric cam 362.

Figure 8:
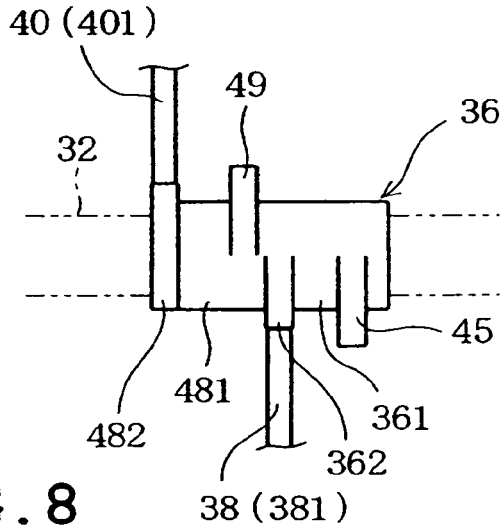
FIG. 8 is a front view of a feed contact, an auxiliary feed contact, an up-down feed cam and a needle plate adjusting mechanism, showing the positional relationship thereamong.

The cam assembly 36 further includes an auxiliary concentric cam 481, an auxiliary eccentric cam 482 and an auxiliary needle plate adjusting cam 49 as shown in FIG. 8. More specifically, the concentric cam 361 and the auxiliary concentric cam 481 have the same cam contour, and the eccentric cam 362 and the auxiliary eccentric cam 482 have respective cam contours substantially similar to each other although none of the cam contours are shown. The needle plate cam 45 and the auxiliary needle plate cam 49 also have respective cam contours substantially similar to each other although neither cam contour is shown. However, the eccentric cam 362 and the auxiliary eccentric cam 482 have cam surfaces with maximum radius portions which are displaced by a predetermined phase (angle), respectively. The needle plate adjusting cam 45 and the auxiliary needle plate adjusting cam 49 also have cam surfaces with maximum radius portions which are displaced by a predetermined phase (angle). An auxiliary feed contact 40 is adapted to be brought into contact with any one of the auxiliary concentric cam 481, the auxiliary eccentric cam 482 and the auxiliary needle plate adjusting cam 49 as will be described later.

The feed bar 35 has a rear end provided with a height adjusting bolt 46 which adjusts an amount of protrusion of the upper end of the feed dog 23 from an upper surface of the needle plate 21. The bolt 46 has a lower end which is in contact with an upper end of the pin 37. The pin 37 is supported on the unit frame 42 so as to be movable upward and downward. The rear end or the pin 37 side of the feed bar 35 is normally urged downward by a spring member (not shown). The pin 37 has a lower end which is in contact with the feed contact 38. The feed contact 38 has a front end provided with a cam contact portion 381 and a rear end provided with a pin contact portion 382. The cam contact portion 381 formed on the front end of the feed contact 38 is brought into contact with any one of the concentric cam 361, the eccentric cam 362 and the needle plate adjusting cam 45 of the cam assembly 36. Furthermore, the pin contact portion 382 formed on the rear end of the feed contact 38 is brought into contact with the lower end of the pin 37. Thus, the bolt 46, the pin 37 and the feed contact 38 are normally in contact with one another. Furthermore, the cam contact portion 381 is normally in contact with any one of the concentric cam 361, the eccentric cam 362 and the needle plate adjusting cam 45.

A contact support shaft 47 is disposed in the back of the lower shaft 32 in parallel to the shaft 32. The feed contact 38 is supported by the contact support shaft 47 so as to be swingable about the shaft 47 and so as to be axially movable. The cam contact portion 381 is brought into contact with a rear underside of any one of the concentric cam 361, the eccentric cam 362 and the needle plate adjusting cam 45. When the feed contact 38 is moved axially with respect to the contact support shaft 47, the cam contact portion 381 is selectively brought into contact with any one of the concentric cam 361, the eccentric cam 362 and the needle plate adjusting cam 45. The feed contact 38 is allowed to be axially moved only when the cam contact portion 381 is in contact with the minimum radius portion of the cam surface of the eccentric cam 362 or the needle plate adjusting cam 45. When the lower shaft 32 is rotated thereby to rotate the eccentric cam 362 in the case where the cam contact portion 381 is in contact with the eccentric cam 362, the feed contact 38 is swung about the contact support shaft 47, as shown in FIG. 7.

Figure 9:
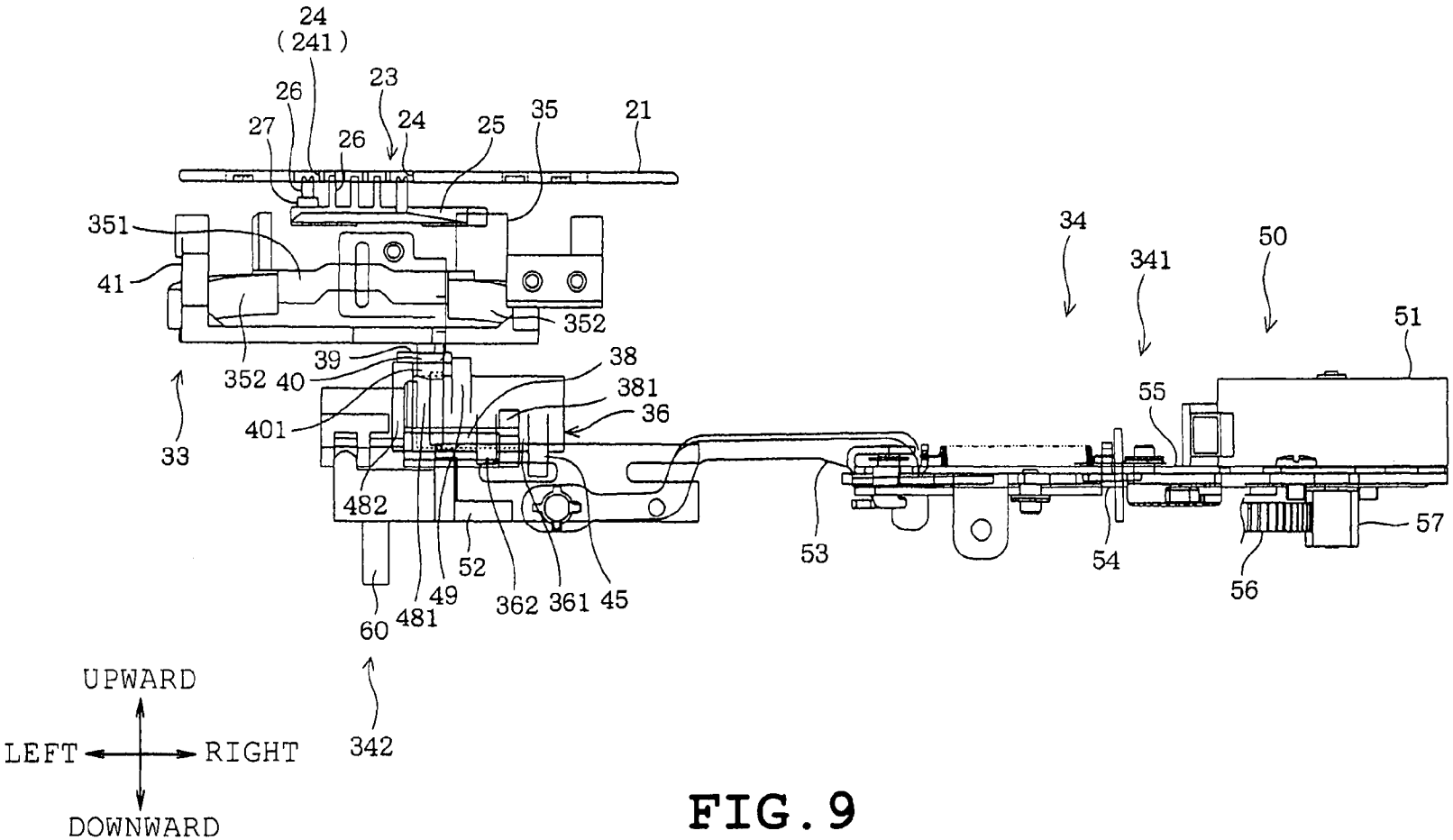
FIG. 9 is a view similar to FIG. 3, showing the case where the feed dog assumes a lower position.
Figure 10:
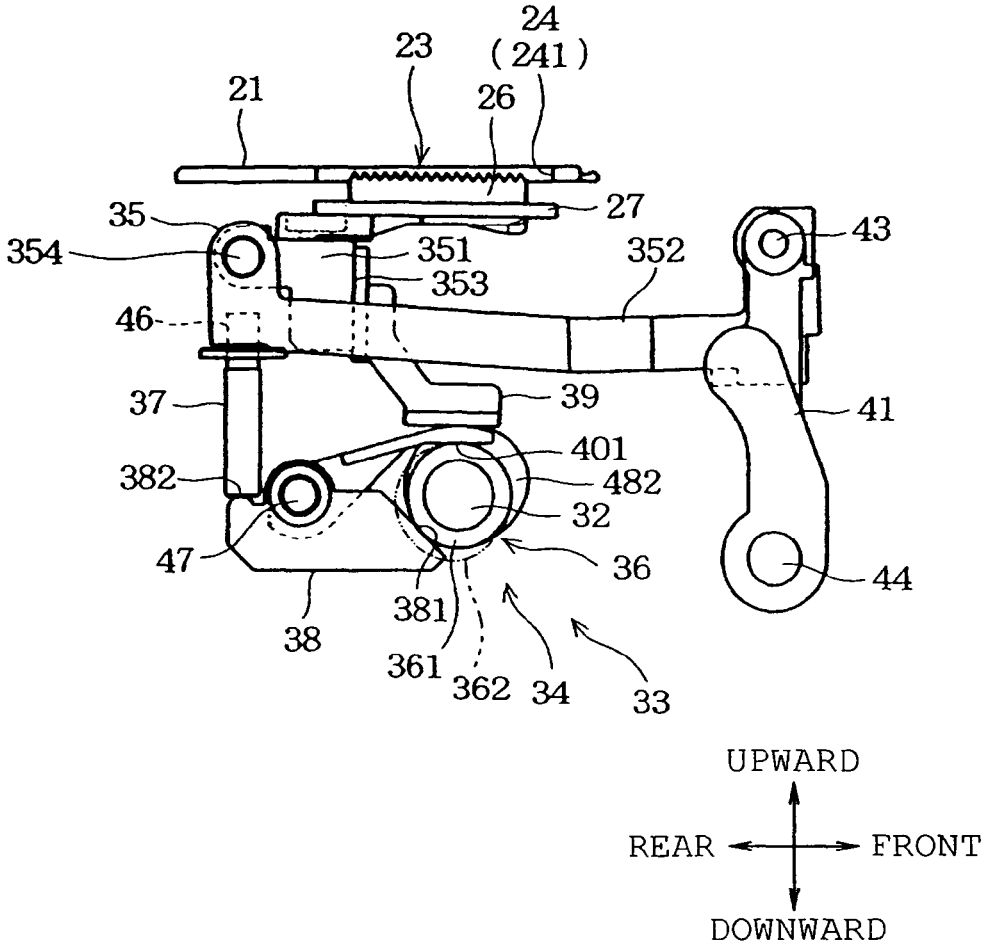
FIG. 10 is a view similar to FIG. 7, showing the case where the feed dog assumes the lower position.
Figure 11:
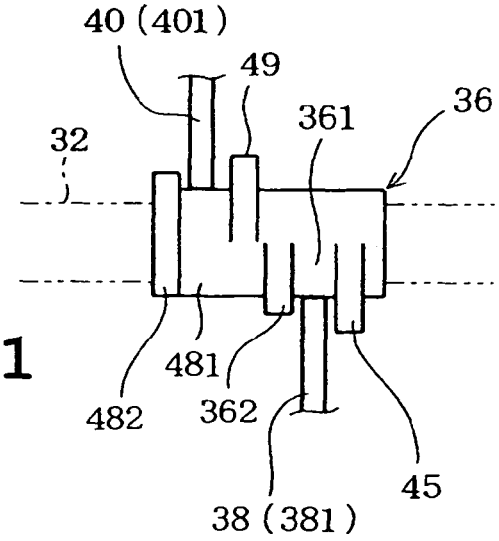
FIG. 11 is a view similar to FIG. 8, showing the case where the feed dog assumes the lower position.
Figure 15A:
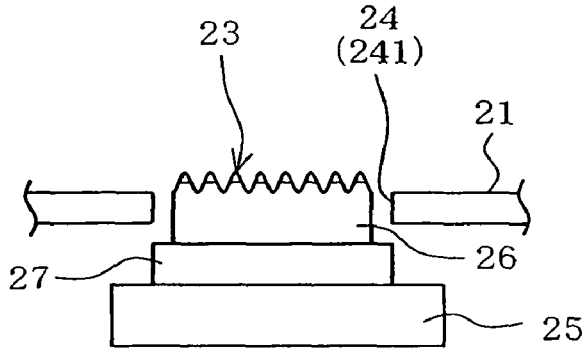
FIGS. 15A to 15C are schematic views showing the position of the feed dog.
Figure 15B:
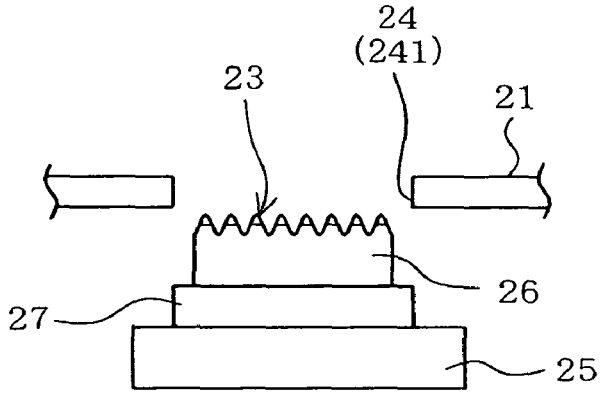

When the cam contact portion 381 is brought into contact with the maximum radius portion of the cam surface of the eccentric cam 362, the feed contact 38 is rotated clockwise such that the pin contact portion 382 is moved upward, as shown in FIG. 7. Accordingly, the pin 37 pushes the feed bar 35 upward. On the other hand, the feed contact portion 381 is rotated counterclockwise such that the pin contact portion 382 is moved downward, as the cam contact portion 381 is moved to the minimum radius portion of the cam surface of the eccentric cam 362 upon rotation of the eccentric cam 362. Accordingly, the feed bar 35 is moved downward together with the pin 37. When the feed bar 35 has been pushed upward by the pin 37, the feed dog 23 assumes an upper position where the feed dog 23 comes into contact with the workpiece cloth, as shown in FIG. 15A. On the other hand, when the feed bar 36 has been moved downward together with the pin 37, the feed dog 23 assumes a lower position where the feed dog 23 is out of contact with the workpiece cloth, as shown in FIG. 15B. Thus, the feed dog 23 is moved between the upper and lower positions by the rotation of the eccentric cam 362 with rotation of the lower shaft 32. Furthermore, when the cam contact portion 381 is brought into contact with the concentric cam 361, the feed contact 38 is not swung even when the concentric cam 361 is rotated, as shown in FIGS. 9 to 11. Accordingly, the pin contact portion 382 is located lower such that the feed dog 23 assumes the lower position.

The feed bar 35 is swung in the front-back direction when the swing lever 41 is swung by the rotation of the lower shaft 32, as described above. Furthermore, the feed bar 35 is also swung upward and downward when the pin 37 is moved upward and downward. More specifically, the feed dog 23 mounted on the feed bar 35 carries out the well-known Four Movements, thereby transferring the workpiece cloth rearward from the front and frontward from the rear. Thus, the feed dog 23 is moved upward and downward between the upper and lower positions, and the position of the feed dog 23 in this case will be referred to as a transfer position.

On the other hand, the auxiliary feed contact 40 has the end (proximal end) which is opposite to the cam assembly 36 and supported on the contact support shaft 47 so that the auxiliary feed contact 40 is swingable and is axially movable. The auxiliary feed contact 40 has an auxiliary cam contact portion 401 on the end (distal end) at the cam assembly 36 side. When the auxiliary feed contact 40 is moved axially with respect to the contact support shaft 47, the auxiliary cam contact portion 401 is selectively brought into contact with any one of the auxiliary concentric cam 481, the auxiliary eccentric cam 482 and the auxiliary needle plate adjusting cam 49. However, the auxiliary feed contact 40 is allowed to be axially moved only when the auxiliary cam contact portion 401 is in contact with the minimum radius portion of the cam surface of the auxiliary eccentric cam 482 or the auxiliary needle plate adjusting cam 49. The auxiliary cam contact portion 401 is brought into contact with an upper portion of each cam. The auxiliary cam contact portion 401 is interposed between the auxiliary up-down movement member 39 and the cam assembly 36. The auxiliary up-down movement member 39 has a proximal end fixed to a front end 353 of the body 351 of the feed bar 35.

The open leg 352 is provided with a pin 354 on which the body 351 of the feed bar 35 is mounted so as to be swingable, although the construction is not shown in detail. More specifically, the auxiliary up-down movement member 39 fixed to the body 351 is also mounted on the pin 354 so as to be swingable. Furthermore, the auxiliary up-down movement member 39 is normally urged elastically downward by a spring member (not shown). Accordingly, the distal end of the auxiliary up-down movement member 39 and the auxiliary cam contact portion 401 are normally in contact with any one of the auxiliary concentric cam 481, the auxiliary eccentric cam 482 and the needle plate adjusting cam 49.

The feed contact 38 and the auxiliary feed contact 40 are constructed so as to be moved axially with respect to the contact support shaft 47 in conjunction with each other, although the construction is not shown in detail. More specifically, when the feed contact 38 is in contact with the eccentric cam 362, the auxiliary feed contact 40 is in contact with the auxiliary eccentric cam 482. Furthermore, when the feed contact 38 is in contact with the concentric cam 361, the auxiliary feed contact 40 is in contact with the auxiliary concentric cam 481. When the feed contact 38 is in contact with the needle plate adjusting cam 45, the auxiliary feed contact 40 is in the auxiliary needle plate cam 49. Thus, when the auxiliary up-down movement member 39 is moved in conjunction with the feed contact 38 thereby to be brought via the auxiliary cam contact portion 401 into contact with any one the aforementioned cams, the upper end surface of the feed dog 23 or the contact surface of the feed dog 23 with the workpiece cloth 45 is normally retained in a posture substantially parallel to the upper surface of the needle plate 21.

Figure 15C:
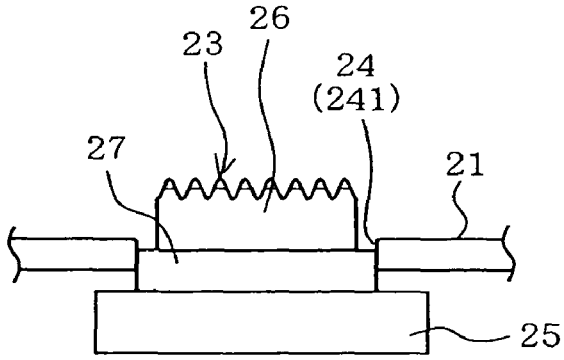

The needle plate adjusting cam 45 of the cam assembly 36 has a cam surface with a maximum radius which is set so as to be larger than the maximum radius of the eccentric cam 362. Accordingly, when the cam contact portion 381 of the feed contact 38 is in contact with the maximum radius portion of the cam surface of the needle plate adjusting cam 45, the cam contact portion 381 is pushed further downward as compared with the case where the feed contact 38 is in contact with the maximum radius portion of the cam surface of the eccentric cam 362. On the other hand, the auxiliary needle plate adjusting cam 49 also has a cam surface with a maximum radius which is set so as to be larger than the maximum radius of the auxiliary eccentric cam 482. Accordingly, when the auxiliary cam contact portion 401 of the auxiliary feed contact 40 is in contact with the maximum radius portion of the cam surface of the auxiliary needle plate adjusting cam 49, the auxiliary cam contact portion 401 is pushed further upward as compared with the case where the auxiliary feed contact 40 is in contact with the maximum radius portion of the cam surface of the auxiliary eccentric cam 482. Consequently, the feed dog 23 mounted on the feed bar 35 in contact with the pin 37 is pushed to a position located higher than the aforementioned upper position while the upper end surface thereof is retained in the posture substantially parallel to the upper surface of the needle plate 21, as shown in FIG. 15C. The aforesaid position located higher than the aforementioned upper position serves as a needle plate adjusting position.

The feed dog 23 protrudes from the needle plate 21 to a large extent when having been pushed higher than the predetermined upper position. The fitting portion 27 of the feed dog 23 is raised to a plane substantially coplanar with the needle plate 21. As a result, the fitting portion 27 is fittable into the engagement rectangular hole 241 of the needle plate 21. In this case, it is assumed that the position (a position where an amount of feed is zero, for example) of the feed bar 35 or the feed dog 23 with respect to the front-back direction is maintained by a feed amount adjusting mechanism (not shown) so as not to be changed to another position. Accordingly, the position of the fitting portion 27 relative to the bed 11 is fixed. As a result, the fitting portion 27 is fitted into the engagement rectangular hole 241 of the needle plate 21 when the needle plate 21 is replaced by a dedicated needle plate according to a sewing pattern of straight stitches or zigzag stitches, or when a new replacing needle plate 21 is attached or the needle plate 21 once detached is re-attached in the maintenance work or the like. Consequently, the position of the needle plate 21 is determined, whereupon the positional relationship between the needle plate 21 and the bed 11 can accurately be determined.

The following describes a switching device 34 serving as a switching unit which switches the position of the feed dog 23. The switching device 34 includes an automatic switching device 341 or a manual switching device 342 as shown in FIGS. 2, 3, 9 and 12. The construction of the automatic switching device 341 is similar to that disclosed by Japanese patent application publication, JP-A-2007-244721. Accordingly, the automatic switching device 341 will be described in brief here. The automatic switching device 341 includes a switching mechanism 50 which further includes a touch panel 20 serving as an instruction unit, a pulse motor 51 serving as an actuator, a contact moving member 52, a first slide lever 53, a second slide lever 54, a driven gear 56, a driving gear 57 and a control device (not shown).

The control device comprises a microcomputer, for example and electrically controls the whole sewing machine 10 including the switching device 34 in accordance with a computer program stored on a storage device (not shown). A key switch 18 and the touch panel 20 are electrically connected to the control device, whereby the control device accepts instructions the user enters through the key switch 18 and the touch panel 20. Furthermore, the pulse motor 51 is connected to the control device. For example, the control device delivers a signal instructing to drive the pulse motor 51, based on an instruction entered through the touch panel 20. As a result, the pulse motor 51 is rotated clockwise or counterclockwise based on a signal delivered by the control device.

The contact moving member 52 is brought into contact with side surfaces of the feed contact 38 and the auxiliary feed contact 40 to apply a force rightward or left ward from the side surfaces, thereby moving the feed contact 38 and the auxiliary feed contact 40 axially with respect to the contact support shaft 47. The first slide lever 53 has a left end connected to a right end of the contact moving member 52 and a right end connected via a swing lever (not shown) to the second slide lever 54. A drop unit frame 55 is provided on the right of the unit frame 42. The first and second slide levers 53 and 54 are mounted on the drop unit frame 55 so as to be movable in the right-left direction.

The driven gear 56 is provided on the right of the second slide lever 54. Upon rotation of the driven gear 56, the second slide lever 54 is driven in the right-left direction. The driven gear 56 is in mesh engagement with the driving gear 57 fixed to a drive shaft of the pulse motor 51. Accordingly, when the pulse motor 51 is rotated thereby to rotate the driving and driven gears 57 and 56, the second slide lever 54 is moved rightward or leftward, and the first slide lever 54 is also moved via the swing lever (not shown) rightward or leftward. When the first slide lever 53 is moved rightward or leftward, the contact moving member 52 is moved in the same direction as the first slide lever 53 is moved, thereby moving the feed contact 38 and the auxiliary feed contact 40.

The construction of the manual switching device 342 will now be described. When the sewing machine 10 is equipped with the manual switching device 342, the above-described automatic switching device 50 is kept inoperative or need not be equipped. The manual switching device 342 is provided with an operating member 60 connected to the contact moving member 52. The operating member 60 has a distal end which protrudes from an outer cover member (not shown) covering the bed 11 so as to be operable by the user. The contact moving member 52 is moved rightward or leftward when the user grips and moves the operating member 60 rightward or leftward. The contact moving member 52 is held at a predetermined position in the right-left direction by a holding spring (not shown).

The above-described sewing machine 10 will work as follows. A sewing machine motor (not shown) is activated when the user touches the start/stop key 181. Upon activation of the motor, the main shaft is rotated by a driving force generated by the motor. The lower shaft 32 is also rotated in conjunction with the main shaft. The needle bar 15 and the needle thread take-up (not shown) are driven as the result of rotation of the main shaft. The rotary hook 30 is driven as the result of rotation of the lower shaft 32. Furthermore, the rotation of the lower shaft 32 also drives the feed dog 23 in the front-back direction and the up-down direction so that the workpiece cloth placed on the upper surfaces of the bed 11 and the needle plate 21 is transferred rearward from the front or frontward from the rear. As a result, stitches are formed on the workpiece cloth in cooperation between the needle 17 attached to the lower end of the needle bar 15 and the rotary hook 30.

When the sewing machine 10 is equipped with the automatic switching device 341, the control device (not shown) drives the pulse motor 51 to move the first slide lever 53 leftward. The first slide lever 53 is maintained at the leftward position. More specifically, since the first slide lever 53 is located at the leftward position, the contact moving member 52 is also located at a leftward position, as shown in FIGS. 3, 7 and 8. Furthermore, when the sewing machine 10 is equipped with the manual switching device 342, the user moves the operating member 60 leftward, whereby the contact moving member 52 is maintained at a leftward position.

The following describes a manner of attaching the needle plate 21 to the bed 11. The needle plate 21 is detached from the bed 11 when replaced by another needle plate 21 which is desired by the user and suitable for the sewing pattern or when a maintenance work is executed for the sewing machine 10. When the replacing needle plate 21 is attached or the needle plate 21 once detached is re-attached to the bed 11, the user depresses a needle plate position adjusting key of the touch panel 20. Upon operation of the needle plate position adjusting key, the control device drives the sewing machine motor (not shown) to rotate the cam assembly 36 (the lower shaft 32) so that the feed contact 38 and the auxiliary feed contact 40 are rendered movable in the right-left direction or so that the feed dog 23 assumes the lower position. The detector (not shown) detects a rotation phase of the lower shaft 32 or the cam assembly 36. The control device drives the sewing machine motor based on a signal delivered by the detector. The control device stops the sewing machine motor when the feed dog 23 assumes the lower position. Furthermore, the control device controls the feed amount adjusting mechanism so that the feed dog 23 is maintained at a predetermined position in the front-back direction (the position where the feed amount is zero, for example).

Figure 12:
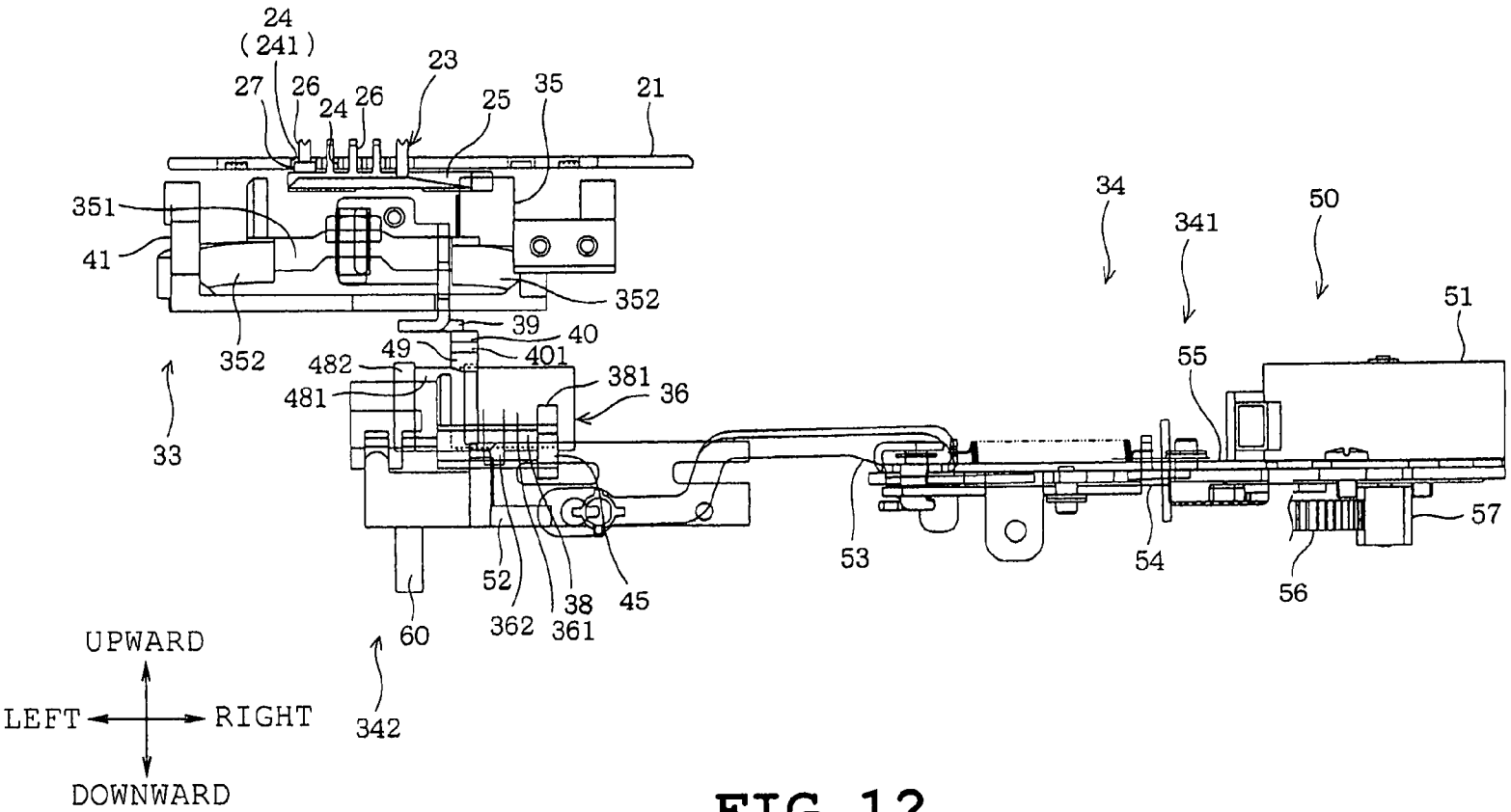
FIG. 12 is a view similar to FIG. 3, showing the case where the feed dog assumes a needle plate adjusting position.
Figure 13:
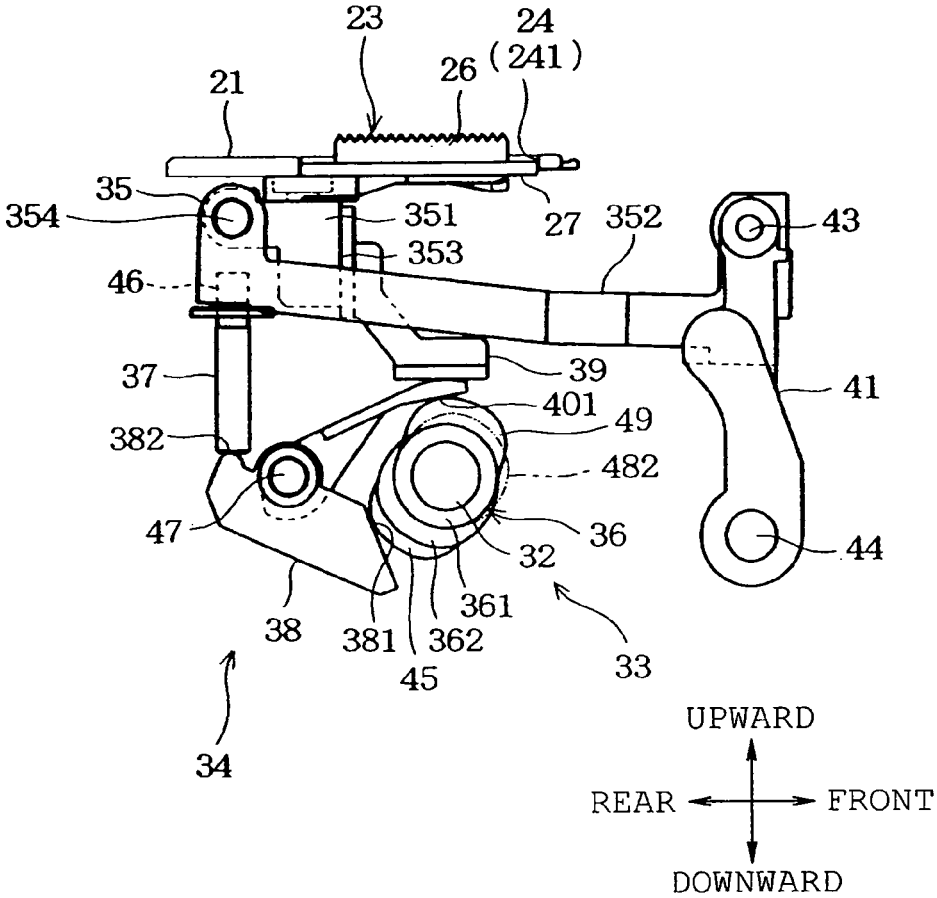
FIG. 13 is a view similar to FIG. 7, showing the case where the feed dog assumes the needle plate adjusting position.
Figure 14:
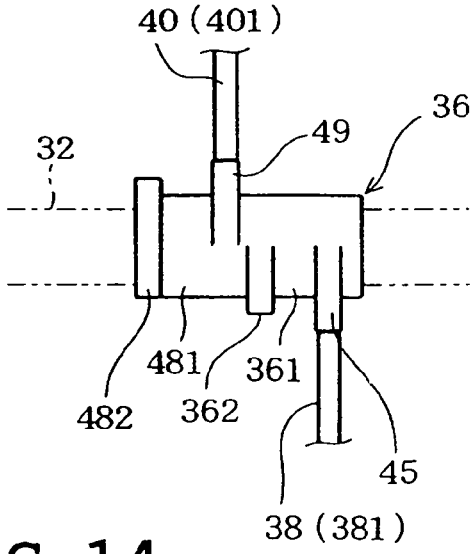
FIG. 14 is a view similar to FIG. 8, showing the case where the feed dog assumes the needle plate adjusting position.

When the sewing machine 10 is equipped with the automatic switching device 341, the pulse motor 51 is rotated so that the first slide lever 53 is moved rightward as shown in FIGS. 12 to 14. As a result, the contact moving member 52 is moved rightward. Furthermore, when the sewing machine 10 is equipped with the manual switching device 342, the user moves the operating member 60 rightward thereby to move the contact moving member 52 rightward. The feed contact 38 is brought into contact with the needle plate adjusting cam 45 of the cam assembly 36 when the contact moving member 52 has been moved to the right end side. Thereafter, the sewing machine motor is rotated to turn the cam assembly 36 about 180 degrees and subsequently, the motor is stopped. As a result, the feed contact 38 is pushed further downward as compared with the case where the feed contact 38 is in contact with the maximum radius of the cam surface of the eccentric cam 362. Consequently, the feed dog 23 is subjected to an upward force from the feed contact 38 and the pin 37, thereby being pushed to the needle plate adjusting position which is located higher than the upper position.

Regarding the auxiliary feed contact 40, and the auxiliary eccentric cam 482 and the auxiliary needle plate adjusting cam 49, the upper end surface of the feed dog 23 pushed upward to the needle plate adjusting position is retained in the posture substantially parallel to the upper surface of the needle plate 21 in the same manner as described above.

The fitting portion 27 of the feed dog 23 is substantially coplanar with the needle plate 21 when the feed dog 23 assumes the needle plate adjusting position. In this case, when the fitting portion 27 is fitted into the engagement rectangular hole 241 of the needle plate 21, the needle plate 21 is accurately positioned relative to the feed dog 23. The needle plate 21 is then fixed to the bed 11 (the unit frame 42 in the embodiment) by the tension screws 28 while the fitting portion 27 is fitted in the engagement rectangular hole 241. As a result, the attachment of the needle plate 21 to the bed 11 is completed.

The following describes effects of the above-described sewing machine 10. According to the above-described sewing machine 10, the needle plate adjusting position is provided which determines the fixing point of the needle plate 21 relative to the bed 11. The needle plate adjusting position differs from a transfer position where the feed dog 23 transfers the workpiece cloth. When the needle plate 21 is attached to the bed 11, the control device drives the automatic switching device 341 or the manual switching device 342 is manually operated by the user, so that the feed dog 23 is switched to the needle plate adjusting position, whereby the feed dog 23 is moved to the needle plate adjusting position. The fixing point of the needle plate 21 relative to the bed 11 is determined by positioning the needle plate 21 so that the fitting portion 27 of the feed dog 23 assuming the needle plate adjusting position is fitted into the engagement rectangular hole 241 of the needle plate 21. Consequently, the fitting point of the needle plate 21 relative to the bed 11 can be determined easily and accurately.

The engagement rectangular hole 241 which is one of the rectangular holes 24 of the needle plate 21 serves as the engaged portion, and the fitting portion 27 of the feed dog 23 serves as the engaging portion. Accordingly, no parts dedicated to positioning the needle plate 21 need to be added. Consequently, the fixing point of the needle plate 21 relative to the bed 11 can be determined by a simple construction without increasing the number of parts and complicating the structure of the sewing machine 10.

When the needle plate 21 is to be positioned, the feed dog 23 is moved to the needle plate adjusting position located higher than the upper position where the workpiece cloth is transferred. Thus, the feed dog 23 protrudes higher than when the workpiece cloth is transferred. Accordingly, the fitting portion provided on the feed dog 23 can be fitted into the engagement rectangular hole 241 formed in the needle plate 21. Consequently, the fixing point of the needle plate 21 relative to the bed 11 can be determined in the simple construction by addition of the construction to drive the feed dog 23 upward.

The vertical position of the feed bar 35 on which the feed dog 23 is provided is changed by switching the feed contact 38 between the contact with the eccentric cam 362 of the cam assembly 36 and the contact with the needle plate adjusting cam 45. Accordingly, the feed dog 23 can be switched between the transfer position and the needle plate adjusting position by employment of a simple construction.

The feed dog 23 is switched between the transfer position and the needle plate adjusting position on the basis of the signal generated by the touch panel 20. When the instruction to switch the position of the feed dog 23 is entered through the touch panel 20, the control device drives the pulse motor 51 so that the cam of the cam assembly 36 to be brought into contact with the feed contact 38 is switched. Consequently, the feed dog 23 can be switched between the transfer position and the needle plate adjusting position by operating the touch panel 20.

The operating member 60 may also be manually operated in order that the feed dog 23 may be switched between the transfer position and the needle plate adjusting position. Consequently, the feed dog 23 can be switched between the transfer position and the needle plate adjusting position without provision of a drive source such as the pulse motor 51. Furthermore, the upper end of the fitting portion 27 is located in the engagement rectangular hole 241 and does not protrude from the upper surface of the needle plate 21. Accordingly, the fitting portion 27 can be prevented from being caught by the workpiece cloth on the needle plate 21, whereby the sewing operation can be prevented from being obstructed.

The foregoing embodiment should not be restrictive but may be modified or expanded as follows.

In the foregoing embodiment, the fitting portion 27 serving as the engaging portion is provided on the feed dog 23, and the engagement rectangular hole 241 of the rectangular holes 24 serves as the engaged portion. However, the fitting portion 27 serving as the engaging portion may be provided on the feed bar 35, instead of the feed dog 23. In this case, the engaged portion provided in the needle plate 21 is provided at a position with which the engaging portion engages when the feed bar 35 assumes the needle plate adjusting position.

Although the touch panel 20 is employed as the instruction unit in the foregoing embodiment, a dedicated switch may be provided, instead. The dedicated switch may be operated so that a signal is delivered to switch the position of the feed dog 23.

Moreover, the following additional modifications and expansions are included. The engagement rectangular hole 241 and the fitting portion 27 have respective rectangular sections in the up-down direction which is the direction in which the feed dog 23 is driven. Accordingly, horizontal positions of the engagement rectangular hole 241 and the fitting portion 27 can be determined when the engagement rectangular hole 241 and the fitting portion 27 partially abut on each other. Accordingly, the needle plate 21 can easily be mounted on a predetermined position without positioning the feed dog 23 accurately. As a result, the drive control and mounting adjustment of the feed dog 23 can easily be carried out.

Figure 16A:
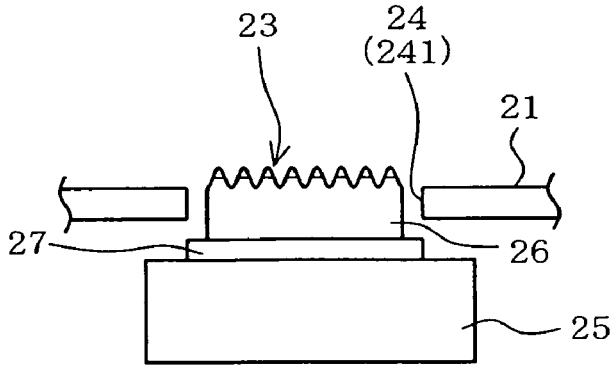
FIGS. 16A to 16C are views similar to FIGS. 15A to 15C, showing another illustrative example.
Figure 16B:
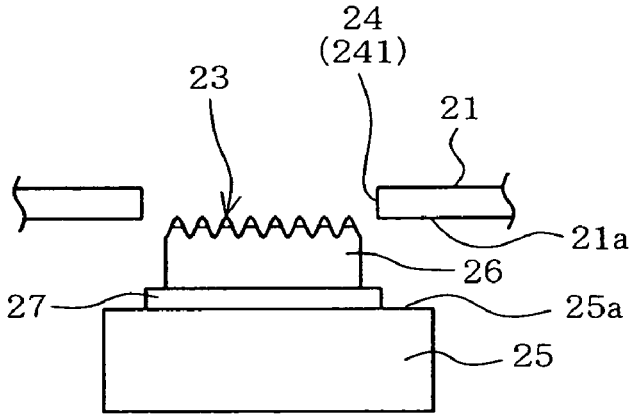
Figure 16C:
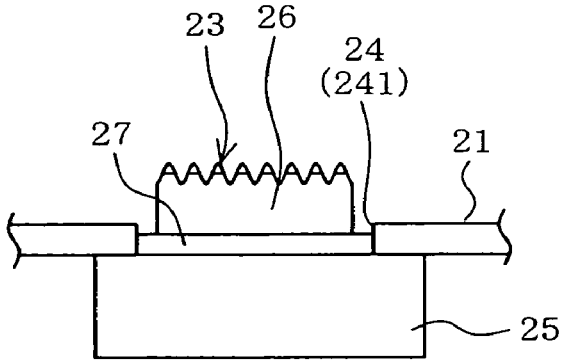

The horizontal position of the feed dog 23 is determined by the side surface of the fitting portion 27 in the foregoing embodiment as shown in FIG. 15C. However, as shown in FIGS. 16A to 16C, a side surface of the fitting portion 27 may abut on a wall surface of the engagement rectangular hole 241, and an upper surface 25*a* of the feed bar 25 may abut on the underside 21*a* of the needle plate 21, instead. More specifically, the fitting portion 27 may be positioned in the up-down direction as well as the horizontal direction.

Figure 17A:
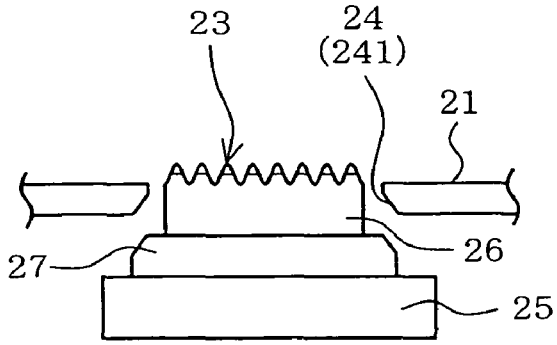
FIGS. 17A to 17C are views similar to FIGS. 15A to 15C, showing further another illustrative example.
Figure 17B:
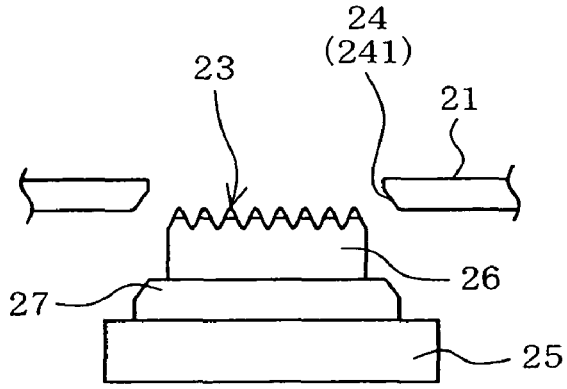
Figure 17C:
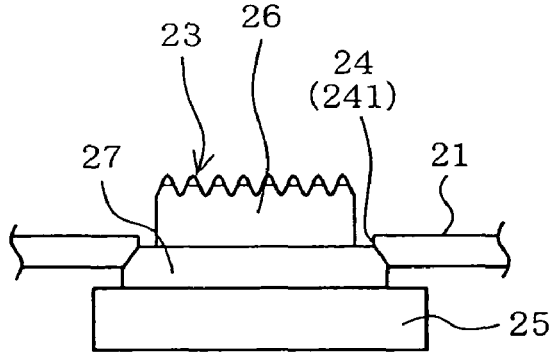
Figure 18A:
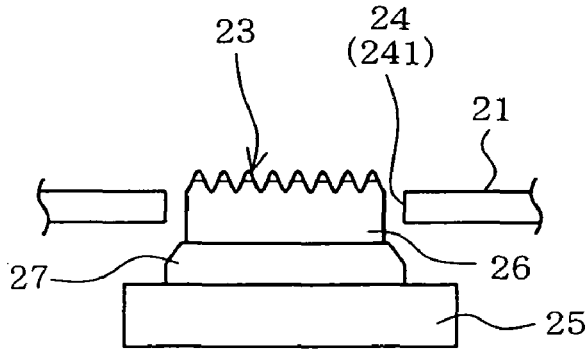
FIGS. 18A to 18C are views similar to FIGS. 15A to 15C, showing still further another illustrative example.
Figure 18B:
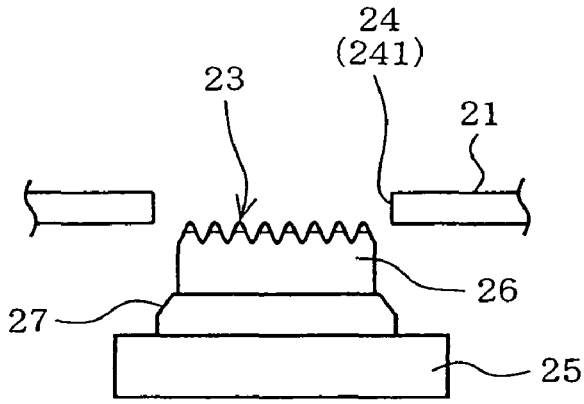
Figure 18C:
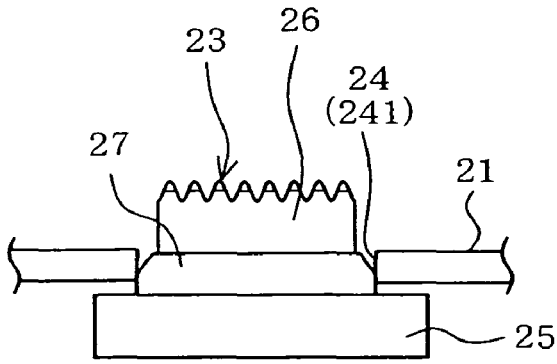

The engagement rectangular hole 241 and the fitting portion 27 have the horizontal and vertical sections both of which are rectangular in shape, respectively. However, at least either one of the horizontal and vertical sections may take another shape. For example, as shown in FIGS. 17A to 17C, each of the engagement rectangular hole 241 and the fitting portion 27 may be constructed so that at least a part thereof in the up-down direction has a width that is gradually increased as the part goes downward. In this case, too, the fitting portion 27 may be constructed so as to determine the vertical position of the feed dog 23 as well as the horizontal position of the feed dog 23. Additionally, the width of the distal end of the fitting portion 27 may be reduced so that the fitting portion 27 easily engages the engagement rectangular hole 241.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a feed dog configured to transfer workpiece cloth;

a needle plate having a first hole through which a needle is configured to be passed and a second hole through which a feed dog is configured to be movable upward and downward;

a bed to which the needle plate is detachably attachable;

a feeding mechanism configured to drive the feed dog in a front-back direction and in an up-down direction;

an engaged portion provided in the needle plate;

an engaging portion provided in the feed dog or the feeding mechanism; and a switching unit configured to switch the feed dog or the feeding mechanism between a transfer position where the feed dog is configured to transfer the workpiece cloth and a needle plate adjusting position which differs from the transfer position and where the engaging and engaged portions are engaged with each other, wherein the needle plate adjusting position corresponds to a position where the needle plate is fixed on the bed.

2. The sewing machine according to claim 1, wherein the second hole serves as the engaged portion, and the engaging portion is provided in the feed dog and serves as a fitting portion fitted into the second hole.

3. The sewing machine according to claim 2, wherein the second hole serving as the engaged portion has a wall surface and the engaging portion has a side surface which is fitted with the wall surface of the second hole over substantially a whole circumference.

4. The sewing machine according to claim 3, wherein the second hole serving as the engaged portion and the engaging portion have rectangular vertical sections respectively.

5. The sewing machine according to claims 1, wherein the needle plate adjusting position is located higher than the transfer position.

6. The sewing machine according to claim 1, wherein:

the feed mechanism includes:

a feed bar configured to support the feed dog so that the feed dog is swingable in an up-down direction;

an up-down feed cam configured to drive the feed dog and the feed bar in an up-down direction; and a feed contact configured to be brought into contact with the up-down feed cam to move the feed dog and the feed bar in the up-down direction, and the switching unit includes:

a needle plate adjusting cam configured to raise the feed dog to the needle plate adjusting position; and a switching mechanism configured to switch the feed contact between a first position where the feed contact is brought into contact with the up-down feed cam and a second position where the feed contact is brought into contact with the needle plate adjusting cam.

7. The sewing machine according to claim 6, wherein the switching mechanism includes:

a command unit configured to deliver a signal which switches the feed dog between the transfer position and the needle plate adjusting position; and an actuator configured to change the feed dog between the transfer position and the needle plate adjusting position based on the signal delivered by the command unit.

8. The sewing machine according to claim 6, wherein the switching mechanism includes an operating member which is manually operated so that the feed dog is switched between the transfer position and the needle plate adjusting position.

9. The sewing machine according to claim 1, wherein the engaging portion has an upper end located in the second hole serving as the engaged portion.

* * * * *